US010231288B2

(12) United States Patent
Kiss et al.

(10) Patent No.: US 10,231,288 B2
(45) Date of Patent: Mar. 12, 2019

(54) VOLTAGE-LEVELING HEATER CABLE

(71) Applicant: nVent Services GmbH, Menlo Park Schaffhausen OT (CH)

(72) Inventors: Linda D. B. Kiss, San Mateo, CA (US); Mohammad Kazemi, San Jose, CA (US); Peter Martin, San Ramon, CA (US); Edward Park, Menlo Park, CA (US)

(73) Assignee: nVent Services GmbH, Schaffhausen (CH)

( * ) Notice: Subject to any disclaimer, the term of this patent is extended or adjusted under 35 U.S.C. 154(b) by 408 days.

(21) Appl. No.: 14/879,894

(22) Filed: Oct. 9, 2015

(65) Prior Publication Data

US 2016/0105930 A1 Apr. 14, 2016

Related U.S. Application Data

(60) Provisional application No. 62/061,873, filed on Oct. 9, 2014.

(51) Int. Cl.

| | |
|---|---|
| ***H05B 3/56*** | (2006.01) |
| ***H05B 3/12*** | (2006.01) |
| ***H05B 3/14*** | (2006.01) |
| *H01C 7/02* | (2006.01) |

(52) U.S. Cl.

CPC ..... *H05B 3/56* (2013.01); *H05B 3/12* (2013.01); *H05B 3/145* (2013.01); *H01C 7/02* (2013.01); *H05B 2203/014* (2013.01); *H05B 2203/02* (2013.01); *H05B 2203/037* (2013.01); *H05B 2214/04* (2013.01)

(58) Field of Classification Search

CPC ... H05B 3/10; H05B 3/12; H05B 3/34; H05B 3/56; H05B 3/145; H05B 2203/014; H05B 2203/037; H05B 2203/019; H05B 2203/02

USPC ..... 219/538

See application file for complete search history.

(56) References Cited

U.S. PATENT DOCUMENTS

| | | | | |
|---|---|---|---|---|
| 3,410,984 A | | 11/1968 | Sandford et al. | |
| 4,314,145 A | * | 2/1982 | Horsma | H01C 7/027 174/110 PM |
| 4,631,392 A | * | 12/1986 | O'Brien | H05B 3/56 174/102 SC |
| 4,668,857 A | | 5/1987 | Smuckler | |
| 4,845,343 A | * | 7/1989 | Aune | H05B 3/146 219/529 |

(Continued)

FOREIGN PATENT DOCUMENTS

WO 9944391 A1 9/1999

*Primary Examiner* — Brian W Jennison

(74) *Attorney, Agent, or Firm* — Quarles & Brady LLP

(57) ABSTRACT

A heater cable produces a substantially level voltage across its cross-section, providing a uniform and controllable thermal output along its length. The heater cable includes at least one center bus wire extending axially along a central axis of the heater cable, and at least one radial bus wire extending axially through the heating cable and positioned adjacent to the center bus wire. The heater cable further includes a thermally and electrically conductive interstitial material disposed around the at least one center bus wire and the at least one radial bus wire, and a jacket disposed about the interstitial material, the at least one center bus wire, and the at least one radial bus wire.

20 Claims, 8 Drawing Sheets

(56) References Cited

U.S. PATENT DOCUMENTS

| | | | | |
|---|---|---|---|---|
| 6,005,232 | A * | 12/1999 | Janvrin | H05B 3/56 219/528 |
| 6,111,234 | A | 8/2000 | Batliwalla et al. | |
| 7,053,309 | B2 | 5/2006 | Efraimsson et al. | |
| 2009/0184108 | A1 | 7/2009 | O'Connor | |
| 2011/0226754 | A1* | 9/2011 | Malone | H05B 3/56 219/546 |
| 2013/0126212 | A1 | 5/2013 | Martens et al. | |

* cited by examiner

VOLTAGE-LEVELING HEATER CABLE

CROSS-REFERENCE TO RELATED APPLICATIONS

This application is a non-provisional and claims the benefit of U.S. Prov. Pat. App. Ser. No. 62/061,873, entitled "VOLTAGE-LEVELING HEATER CABLE" filed on Oct. 9, 2014.

FIELD OF THE INVENTION

The present invention generally relates to heater cables, and more specifically to self-regulating heater cables.

BACKGROUND OF THE INVENTION

Heater cables, such as self-regulating heater cables, tracing tapes, and other types, are cables configured to provide heat in applications requiring such heat. Heater cables offer the benefit of being field-configurable. For example, heater cables may be applied or installed as needed without the requirement that application-specific heating assemblies be custom-designed and manufactured, though heater cables may be designed for application-specific uses in some instances.

In some approaches, a heater cable operates by use of two or more bus wires having a high conductance coefficient (i.e., low resistance). The bus wires are coupled to differing voltage supply levels to create a voltage potential between the bus wires. A positive temperature coefficient (PTC) material can be situated between the bus wires and current is allowed to flow through the PTC material, thereby generating heat by resistive conversion of electrical energy into thermal energy. As the temperature of the PTC material increases, so does its resistance, thereby reducing the current therethrough and, therefore, the heat generated via resistive heating. The heater cable is thus self-regulating in terms of the amount of thermal energy (i.e., heat) output by the cable.

Heater cables can exhibit high temperature variations throughout the cable, both lengthwise along the length of the cable and across a cross-section of the cable. These high temperature variations may be caused by small high-active heating volumes (e.g., PTC material) within the heater cable that can create localized heating, as opposed to heat spread over a larger surface area or volume. Additionally, in certain configurations, heater cables can be relatively inflexible, or substantially rigid, thus making installation of the heater cable difficult. Further, heater cables are typically not configured to provide varying selective heat output levels by a user.

Though suitable for some applications, such heater cables may not meet the needs of all applications and/or settings. For example, a heater cable that reduces temperature gradients may be desirable in some instances. Further, a heater cable that is relatively flexible and rugged may be desirable in the same or other instances. Further still, a heater cable that is capable of producing varying selective heat output levels may be desirable in the same or other instances.

SUMMARY OF THE INVENTION

Figure 1:
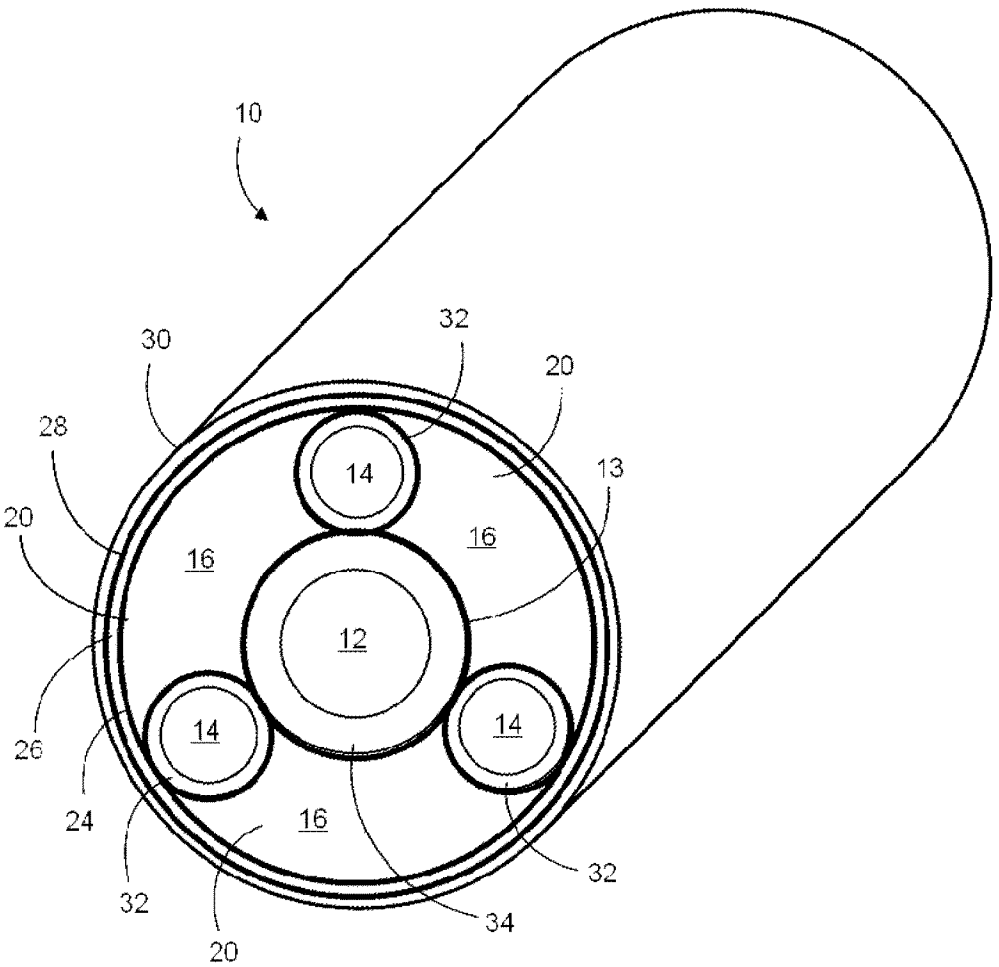
FIG. 1 is a cross-sectional diagram of a heater cable in accordance with various embodiments of the present disclosure.

The present devices and systems provide a heater cable for generating heat when a voltage potential is applied. The heater cable can include at least one center bus wire extending axially along a central axis of the heater cable. The heater cable can further include at least one radial bus wire extending axially through the heating cable and positioned adjacent to the center bus wire. Further, the heater cable can additionally include a thermally and electrically conductive interstitial material disposed around the at least one center bus wire and the at least one radial bus wire; and a jacket disposed about the interstitial coating, the at least one center bus wire, and the at least one radial bus wire.

Additionally, a further heater cable is disclosed. The heater cable can include a center bus wire extending axially along a central axis of the heater cable; at least one radial bus wire extending axially through the heater cable and positioned adjacent to the center bus wire, the at least one radial bus wire being encapsulated with a PTC material; and a thermally and electrically conductive interstitial material disposed around the at least one center bus wire and the at least one radial bus wire, the interstitial material having an electrical resistance substantially less than an electrical resistance of the PTC material.

Furthermore, a heater cable system is disclosed. The heating system can include a power supply and a heater cable. The heater cable can include a center bus wire extending axially along a central axis of the heater cable; at least one radial bus wire extending axially through the heater cable and positioned adjacent to the center bus wire, the at least one radial bus wire being encapsulated with a PTC material having a greater resistance than the at least one radial bus wire and the center bus wire. The heating system further including a thermally and electrically conductive interstitial material disposed around the at least one center bus wire and the at least one radial bus wire; and the center bus wire electrically connected to a first voltage output of the power supply, and the at least one radial bus wire electrically connected to a second voltage output of the power supply, wherein the power supply generates a voltage potential between the center bus wire and the at least one radial bus wire.

DETAILED DESCRIPTION

The present invention overcomes the aforementioned drawbacks by providing in various embodiments a heater cable having a minimized operational temperature gradient. The minimized temperature gradient results in improved thermal equalization, thereby reducing maximum temperature generated at localized points of the heater cable and improving the lifespan of the heater cable. Further, in other embodiments, a heater cable is provided that provides the minimized temperature gradient while increasing flexibility and ruggedness compared to cables with similar dimensions and heating characteristics. In still other embodiments, the heater cable may be capable of selectively outputting varying levels of heat.

Referring now to the figures, FIG. 1 illustrates a cross-sectional view of a heater cable 10 in accordance with various embodiments. The heater cable 10 includes at least one center bus wire 12 and at least one or more radial bus wires 14. The center bus wire 12 may reside within and along the center of the heater cable 10 or within the center of the radial bus wires 14 in certain embodiments. Although the center bus wire 12 is named as such, this does not imply that it necessarily resides within the center of the other radial bus wires 14 or the center of the heater cable 10 in all embodiments. Instead, in certain embodiments the center bus wire 12 may be intertwined or interleaved with the radial bus wires 14. For example, the heater cable can have only two wires—a first wire that may be characterized as the center bus wire 12, and a second wire that may be characterized as one of the radial bus wires 14—and the first and second wires can be twisted or intertwined with each other along the center axis of the heater cable. In another embodiment, the radial bus wires 14 can be wrapped about the center bus wire 12 in a helical or spiral manner along all or part of the heater cable 10 length. The radial bus wires 14 can be helically wrapped around the center bus wire 12 at between 1 and 100 wraps per foot. Preferably, the radial bus wires 14 can be helically wrapped around the center bus wire 12 at between 20 and 80 wraps per foot. Most preferably, the radial bus wires 14 can be helically wrapped around the center bus wire 12 at between 30 and 50 wraps per foot. Additionally, the radial bus wires 14 can be helically wrapped around the center bus wire(s) 12 at a higher wrapping ratio or a lower wrapping ratio than those discussed above. In another embodiment, the radial bus wires 14 can be substantially parallel to, and not intentionally wrapped around, the center bus wire 12. In other embodiments, the radial bus wires 14 can be positioned in an orientation that is not radial about the center bus wire 12. Additionally, other wrapping patterns can be used.

In the embodiment illustrated in FIG. 1, a single center bus wire 12 is shown surrounded by three radial bus wires 14; however any number of center bus wire(s) 12 and/or radial bus wires 14 may be used. For example, and as will be made more apparent, a lesser or greater number of radial bus wires 14 may be used (e.g., one, two, three, four, five, and so forth). If a greater number of radial bus wires 14 are utilized, it may serve, in some embodiments, to further increase the thermal equalization effect described herein. However, for purposes of this disclosure, three radial bus wires 14 are illustrated and described, which teachings may be extrapolated or interpolated and resultantly applied to embodiments including an increased or decreased number of radial bus wires 14 (or center bus wire(s) 12).

In at least one embodiment, the summed cross-sectional area of all of the radial bus wires 14 is equal to the cross-sectional area of the center bus wire 12. However, this is not required in all embodiments and various ratios of cross-sectional areas may be utilized in various application settings. Additionally, in certain embodiments, the various radial bus wires 14 may have uniform or differing cross-sectional areas one from another. Further, the various radial bus wires 14 and/or center bus wire(s) 12 may have circular or non-circular cross-sectional shapes, and may even have differing cross-sectional shapes one from another (e.g., circular, oval, flat, ribbon, and so forth). These different shapes may be useful in certain application settings and are within the scope of the present disclosure.

With continued reference to FIG. 1, an interstitial space 16 can exist between the center bus wire 12, the radial bus wires 14 and an outer jacket 30 of the heater cable 10. The interstitial space 16 can be a void within the heater cable 10. In one embodiment, the interstitial space can contain an interstitial filler material 20. The intersititial filler material 20 can partially or completely fill the interstitial space 16. Additionally or alternatively, some or all of the exterior surface of the center bus wire 12 and/or the radial bus wires 14 can be coated with an interstitial coating 13. The coating 13 can be applied to the bare conductor if any of the wires 12, 14 are not encapsulated by the PTC materials 32, 34 described below, or the coating 13 can be applied to the PTC materials 32, 34. The coating 13 can be applied to each wire 12, 14 individually, or the coating 13 can be applied to an assembly of the center bus wire 12 and the radial bus wires 14. For example, the radial bus wires 14 can be wrapped around the center bus wire 12 as described above, and then the coating 13 can be applied to the exposed exterior surfaces. In a further embodiment, an inner surface of any of the layers disposed around the assembly of wires 12, 14 (e.g., the foil layer 24 or outer jacket 30) can be coated with the interstitial coating 13. Moreover, each or a sub-set of the center bus wires 12, the radial bus wires 14 and the inner surface 22 of the outer jacket 30 can be coated with the interstitial filler material 20.

In one embodiment, the interstitial filler material 20 and/or the interstitial coating 13 can be an electrically and thermally conductive carbon-based material, such as a carbon-based conductive ink. In some embodiments, this electrically and thermally conductive carbon based material can be a paracrystalline carbon coating, such as conductive carbon black. The carbon based material can, for example, have an electrical resistance of about 30 Ohms/square inch to about 230 Ohms per square inch per 25 micro-meters of thickness. In certain embodiments, the interstitial filler material 20 and/or the interstitial coating 13 can be initially made up of a slurry loaded with conductive particles (e.g., carbon black particles). The slurry may be applied to the center bus wire(s) 12 and/or radial bus wires 14, and subsequently dried to remove the diluents post-application in order to form a flexible, solid material. In other embodiments, the interstitial filler material 20 and/or the interstitial coating 13 may include carbon or graphite bound within a matrix to be a flowable and curable polymer. Other examples of possible interstitial filler materials 20 and/or interstitial coatings 13 can include fluoropolymers, primary secondary amine (PSA) carbon black or other carbon blacks (including but not limited to conventional spherical shaped carbon black, acetylene black, amorphous black, channel black, furnace black, lamp black, thermal black, and single-wall or multi-wall carbon nanotubes), graphite (including but not limited to natural, synthetic, or nano), additives (for example, zinc oxide (ZnO) as an antioxidant, boron nitride (BN) as a processing aid, and others), non-carbon-based (e.g., silver-based or polymer-based) conductive inks, and/or mixtures of any of the above.

In some embodiments, including or not including the interstitial filler material 20, the interstitial space 16 can be partially or completely filled with a filler material (not shown). Alternatively, in some examples, various voids can exist which can be filled with a filler material. Non-limiting examples of filler material can be thermally conductive grease, air and other non-volatile gasses, conductive carbon black, graphite, glass fiber, glass bead, metallic powder, metallic fiber, ceramic powder, ceramic fiber, and the like, and combinations of such suitable materials.

The center bus wire(s) 12, the radial bus wires 14, and the interstitial space 16 can form a core of the heater cable 10. In one embodiment, the center bus wire(s) 12, the radial bus wires 14, and the interstitial space 16 are then wrapped in one or more outer jackets 30 to form a functional heater cable 10. The one or more outer jackets 30 can be comprised of multiple layers. For example, in one embodiment, the jacket 30 includes a first metallic foil wrap 24 that is wrapped about the heater cable 10 core and is in electrical contact with the interstitial space 16 and/or the radial bus wires 14. The metallic foil wrap 24 can be an aluminum foil wrap or other pliable, thermally conductive and/or electrically conductive wrap such as Nickel (Ni), Zinc (Zn) or their alloys laminated with polymeric films such as Kapton, Mylar, etc., which can improve tear resistance and mechanical integrity of the metallic foil wrap 24. By using a metallic foil wrap 24 as the first layer, the metallic foil wrap 24 may aid in transferring heat and/or current and/or voltage about the heater cable 10, thus improving thermal equalization.

A dielectric jacket layer 26 may reside outside of the first metallic foil wrap 24, which may be formed of a thin polymer jacket. For example, the dielectric jacket layer may be formed from a polymer material such as a fluropolymer (for example, PFA, MFA, FEP, ETFE, ECTFE, PVDF, etc.), a polyolefin (for example HDPE, EAA, LDPE, LLDPE, etc.), a thermoplastic elastomer (for example, TPO, TPU, etc.) or a cross-linked rubber (for example EPDM, Nitrile, CPE, FKM, etc.). The dielectric jacket layer 26 can provide electrical insulation between the exterior of a heating cable 10, and the conductive elements within the heater cable 10. A second metallic foil wrap 28, which may have the same or similar properties to the first metallic foil wrap 24, may be provided outside of, and immediately adjacent to, an outer surface of the dielectric jacket layer 26. In one example, the second metallic foil wrap 28 can be bonded to the outer surface of the dielectric jacket layer 26. The second metallic foil wrap 28 can be bonded to the dielectric jacket layer using an adhesive. The second metallic foil wrap 28 may serve to help transfer heat around the circumference of the heater cable 10.

Further, the second metallic foil wrap 28 may be in contact with a plurality of small metallic strands defining a drain wire (not shown). The drain wire can be distributed around the heater cable 10 (for example, outside and/or inside of the second metallic foil wrap 28), which can provide an earth ground for the heater cable 10. Lastly, an outer environmental jacket 30 may surround the second metallic foil wrap 28 and/or the drain wires, providing the heater cable 10 both electrical dielectric isolation and physical protection from its surrounding environment. The outer environmental jacket 30 may be made from a thin polymer jacket, or may be formed of rubber, Teflon, or another environmentally resilient material. In one embodiment, the outer environmental jacket 30 may be an extruded jacket, while in another embodiment the outer environmental jacket 30 may be a wrapped jacket, which can be wrapped around the heater cable 10. In one example, the outer environmental jacket 30 can be helically or spiral wrapped around the heater cable 10. Such a wrapped outer jacket may provide an articulated outer surface, which can result in increased flexibility for ease of installation and to better accommodate movement and handling of the heater cable 10 during installation and thereafter. The composition of the outer environmental jacket 30 can depend on the intended temperature rating (i.e., fluoropolymer jacket for high temperature rated heating cables, cross-linked polyolefin jacket for medium/low temperature rated heating cables, etc.). Flexibility may be further improved by helical or spiral wrapping of the radial bus wires 14 about the center bus wire 12, which can also facilitate voltage leveling among the radial bus wires 14 and the central bus wire(s) 14 as described below.

Once assembled, the heater cable 10 may have a circular cross-section, as is shown in FIG. 1. However, in other embodiments and in other application settings the heater cable 10 may take on a triangular cross-sectional shape due to the three radial bus wires 14 disposed about the center bus wire 12. If more radial bus wires 14 are added, the cross-sectional shape may change (e.g., a square for four radial bus wires 14, a pentagon for five radial bus wires 14, and so forth). However, if the radial bus wires 14 are helically wrapped about the center bus wire 12 with relatively high frequency (e.g., more wraps per linear length), the cross-sectional shape may increasingly take a more circular shape. Many different cross-sectional shapes may be possible dependent upon the stacking pattern or wrapping pattern of the radial bus wires 14 and/or the center bus wire(s) 12, the relative cross-sectional sizes of the radial bus wires 14 and/or center bus wire(s) 12, and/or cable construction techniques utilized in the construction of the heater cable 10. Various benefits of the differing cross-sectional shapes, numbers of radial bus wire(s) 14, numbers of center bus wires 12, wrapping patterns, volumes of interstitial space 16, and cross-sectional volumes or shapes of various radial bus wires 14 and/or central bus wire(s) 12 may be realized and may be useful in varying application settings and are considered by this disclosure.

With continued reference to FIG. 1, in one embodiment, the radial bus wires 14 may be encapsulated within a positive temperature coefficient (PTC) material 32. In another embodiment, the center bus wire 12 may be encapsulated with the same, a similar, or a different PTC material 34 compared to the PTC material 32 of the radial bus wires 14. The PTC material 32, 34 encapsulations can be formed of various materials, including polymer-carbon compounds such as PFA, carbon black compounds, polyolefins (including, but not limited to polyethylene (PE), polypropylene (PP), polymethylpentene (PMP), polybutene (PB), polyolefin elastomers (POE), etc.), fluoropolymers (ECA from DuPont™, Teflon® from DuPont™, perfluoroalkoxy polymers (PFA, MFA), polyethylenetetrafluoroethylene (ETFE), polyethylenechlorotrifluoroethylene (ECTFE), fluorinated ethylene-propylene (FEP), polyvinylidene fluoride (PVDF, homo and copolymer variations), Hyflon® from Solvay™ (e.g., P120X, 130X and 140X), polyvinylfluoride (PVF), polytetrafluoroethylene (PTFE), fluorocarbon or chlorotrifluoroethylenevinylidene fluoride (FKM), perfluorinated elastomer (FFKM)), and their mixtures.

Various applications of the PTC material 32, 34 encapsulations are disclosed herein. In one embodiment, the radial bus wires 14 are encapsulated in PTC material 21 while the center bus wire 12 is not (e.g., is bare). In an alternate embodiment, both the radial bus wires 14 and the center bus wire 12 are encapsulated in their respective PTC materials 32, 34. In a further embodiment, the center bus wire 12 is encapsulated with PTC material 34 while all or some of the radial bus wires 14 are not (e.g., are bare). Alternatively, other variations are possible, such as coating only some of the radial bus wires 14. Further, the radial bus wires 14 and the center bus wire(s) 12 can have the same thickness of PTC material 32, 34 applied. Alternatively, the radial bus wires 14 can be encapsulated with one thickness of PTC material 32 and the central bus wire(s) 12 can be encapsulated with a second thickness of PTC material 34 which may be thicker or thinner than the first PTC material 32. Further, the central bus wire(s) 12 and/or the radial bus wires 14 can have varying thicknesses of PTC material 32, 34 along a linear axis of the cable 10 to provide different heating characteristics along the length of the heating cable 10.

The PTC material 32, 34 encapsulations can be high-active heating elements and can operate as heating elements within the heater cable 10. The PTC material 32, 34 encapsulations can generate heat, as the PTC material 32, 34 can have a substantially higher resistance than the conductors of the center bus wire 12 and the radial bus wires 14 (which have negligible resistances), and the interstitial filler material 20 (which can have a negligible to extremely low resistance). Resistive heating is generated by power dissipation. Power (P) is generally defined as $P=I^2\times R$, where "I" represents current and "R" represents resistance. Due to the substantially higher resistance of the PTC material 32, 34, substantially more power is dissipated by the PTC material 32, 34 than the interstitial filler material 20, where current is constant; accordingly, more heat is produced by the PTC materials 32, 34 than from the interstitial filler material 20. The heat generated by the PTC material 32, 34 is then transferred toward the outer jacket 30 of the heater cable 10, and subsequently to the exterior of the heater cable 10. The heat generated by the PTC material 32, 34 can then be transferred to materials or structures which are in close proximity, or in contact with the heater cable 10. Where the heater cable 10 is not in close proximity or in contact with a material or structure, the heat can be dissipated into the surrounding environment. Heat transfer from the PTC material 32, 34 can be affected, in some instances, by the highly thermally conductive characteristic of the interstitial filler material 20. For example, the interstitial filler material 20 can affect the temperature rating and/or power output of the heater cable 10. In one example, the interstitial filler material 20 can increase the temperature rating and/or the power output of the heater cable by providing even current distribution throughout the heater cable 10. Further, the interstitial filler material 20 can increase the temperature rating of the heater cable 10 by allowing for even heat distribution, thereby reducing the possibility of hot spots within the heater cable 10.

The PTC material 32, can limit the current passed through the PTC material 32, 34 based on the temperature of the PTC material 32, 34. The PTC material 32, 34 has a positive temperature coefficient, meaning the material will increase its electrical resistance as its temperature increases. As the resistance of the PTC material 32, 34 increases, the current thereby decreases, and the heat locally generated by the flow of current thereby decreases as well. Thus, the heater cable 10 can be self-regulating in that its resistance varies with temperature. For example, portions of the heater cable 10 will have low resistance where the temperature is below a designed heater cable 10 set-point, thereby leading to higher current between the radial bus wires 14 and the central bus wire(s) 12, and, greater heat generation. Conversely, portions of the heater cable 10 can have higher resistance where the temperature is above the designed heater cable 10 set-point, thereby leading to lower current between the radial bus wires 14 and the central bus wire(s) 12, and, lower heat generation. When the heater cable 10 temperature reaches a designed set-point, the resistance of the PTC material 32, 34 can increase and thereby reduce heat generation.

In this manner, heat is regulated by the PTC material 32, 34 along the length of the heater cable 10 and across the cross-section of the heater cable 10. Further, the above implementation allows for the heater cable 10 to achieve the desired temperature set points along the entire length and cross-section. Further, the heater cable 10 can be designed to allow for multiple temperature set points along its length. In one embodiment, where the radial bus wires 14 are helically or spirally wrapped about the center bus wire(s) 12, virtually equivalent self-leveling of the longitudinal currents in the plurality of radial bus wires 14 can be achieved. For example, in most application settings, due to the helical/spiral wrapping, equal portions of each radial bus wire 14 will reside closest to a heat sink (e.g., a pipe, structure, etc.), thereby effectively equalizing the current load for each individual radial bus wire 14 with respect to the other radial bus wires 14. Further, the helical/spiral wrapping in conjunction with the interstitial coating (or with the interstitial filler material 20 in contact with the wires 12, 14) can aid in voltage leveling by increasing the potential electrical paths for the current to flow between the center bus wire(s) 12 and the radial bus wires 14 of the heater cable 10. This increase in electrical paths can increase the active volume of the PTC material 32, 34 (i.e. increase the surface area of current flow through the PTC material 32, 34) thereby lowering the overall temperature of the PTC material 32, 34, and reducing localized heating.

The desired temperature set points discussed above can be set using multiple methods. For example, the material type and/or thickness of the PTC material 32, 34 encapsulations can be selected to provide the desired temperature set point. Further, the thickness of the PTC material 32, 34 encapsulations can be varied at different positions along the length of the heating cable 10 to provide multiple temperature setpoints along the length of the heating cable 10. Alternatively, the type and/or density of the interstitial filler material 20 in the interstitial space 16 can be varied to provide the desired temperature set point. Furthermore, a voltage applied to the center bus wire(s) 14 can be varied to provide the desired temperature set point. While each of the above methods for setting the desired temperature set point are discussed individually, each of the above examples can be applied individually or in various combinations to provide the desired temperature set point. Additionally, the desired temperature set point can be accomplished by using various combinations of conductor sizes for the radial bus wires 14 and the center bus wire(s) 12 (e.g., 14 AWG, 16 AWG, 20 AWG, etc.). Additionally, various constructions (e.g., number of strands in the conductor) of the conductors can be used for the radial bus wires 14 and the center bus wire(s) 12 to achieve the desired temperature set point.

In one embodiment, a voltage potential is developed between the center bus wire(s) 12 and the radial bus wires 14. For example, the center bus wire(s) 12 may be coupled to a first output of a power supply 50 (FIG. 2) while the radial bus wires 14 may be coupled in parallel to a second output of the power supply 50. When a voltage potential exists between the first output of the power supply and the second output of the power supply, that voltage potential is present between the center bus wire(s) 12 and radial bus wires 14, respectively. For example, the center bus wire(s) 12 may be coupled to a high voltage output while the radial bus wires 14 may be coupled to a neutral voltage output, or vise versa. The high voltage output can be an AC voltage or a DC voltage. Additionally, other configurations are possible, including three-phase AC configurations involving different voltage phases applied to multiple center bus wire(s) 12, and/or radial bus wires 14.

Other embodiments may include selectively coupling and/or decoupling various radial bus wires 14 to/from the respective voltage source (e.g. power supply), or coupling various radial bus wires 14 to multiple voltage potentials. In this manner, in a first configuration, the radial bus wires 14 may all be electrically in parallel to one another (either galvanically or by virtue of having a same voltage potential applied thereto). In such a configuration, each of the radial bus wires 14 may have the same voltage potential relative to the center bus wire 12, which as illustrated below, can have the effect of distributing current and heat more evenly throughout the heater cable 10. In another configuration, one or more of the radial bus wires 14 can be disconnected from the voltage potential source so as to reduce the total amount of heat generated within the heater cable 10. This can allow installers or users of the heater cable 10 to select a desired discrete heat output level by selecting the number of radial bus wires 14 connected to the power source. The selection may be made at the time of installation.

Alternatively, the number of radial bus wires 14 connected to the power source may be adjusted after installation, and can be continually modified to meet the dynamic needs of a specific application setting. For example, during summer months, minimal heat may be needed. Accordingly, only one radial bus wire 14 may need to be connected to the power source 50 to provide the required level of heating. However, during the winter months, maximum heat may be needed, requiring all of the radial bus wires 14 to be connected to the power source 50. In yet another configuration, one or more of the radial bus wires 14 may be connected to the same voltage potential as the center bus wire(s) 12 or another voltage potential all together. By changing the magnitude of the voltage potentials between the radial bus wires 14 and the center bus wire 12, various current and temperature gradients can be achieved, and the overall heat output of the heater cable 10 can be affected, which results may be desirable in some application settings.

In various embodiment as described herein, by distributing a voltage potential to a plurality of radial bus wires 14 that are physically separated from one another, current can flow from the center bus wire 12 to the plurality of radial bus wires 14 in a multitude of varying directions creating a wider and more evenly distributed current field through the interstitial space 16. Additionally, the interstitial coating 13 and/or the interstitial filler material 20 can further allow for wider and more evenly distributed current field through the interstitial space 16. This allows for a more uniform heat generation pattern across the entirety of the PTC encapsulation 32, 34 of the radial bus wires 14 or the center bus wire 12. Additionally, by distributing the radial bus wires 14 across the cross-section of the heater cable 10, the physical locations of the source of heat generation are thereby spread throughout the cross-section of the heater cable 10. This can result in a reduced temperature gradient across the heater cable 10, resulting in better thermal equalization along the length of the heater cable 10.

Further, by placing the radial bus wires 14 around the center bus wire(s) 12, the heater elements can be physically closer to the outside diameter of the heater cable 10. This can result in more efficient heat transfer out of the heater cable 10 and into the surrounding environment. Moreover, by using a heating cable 10 with a plurality of radial bus wires 14, the radial bus wire 14 surface area is increased, thereby increasing the amount of PTC material 32, 34 that can be used within the heater cable 10. This can spread the heat generation over a larger amount of surface area and across a larger volume of the heating cable 10, which can reduce the opportunity for the formation of hot spots. These effects together serve to maximize thermal equalization within the heater cable 10, resulting in more consistent heating along the entire length of the heating cable 10. This may improve the lifespan of the heater cable 10 and reduce the potential for premature failure due to degradation. Further, these effects may improve the unconditional sheath temperature classification of the heater cable 10 as specified by European norm EN60079-30-1.

Figure 2:
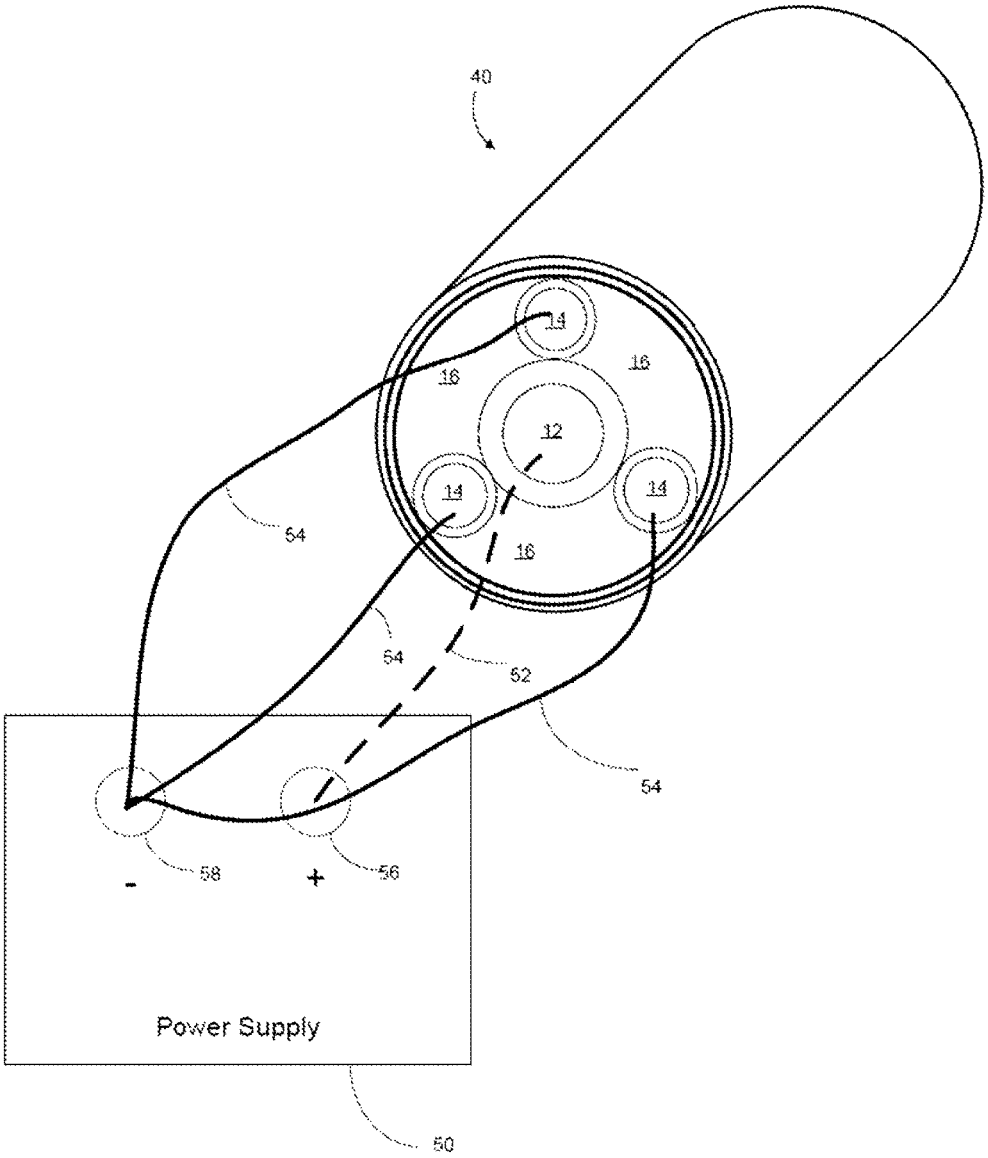
FIG. 2 is a system view of a heater cable system in accordance with various embodiments of the present disclosure.

FIG. 2 illustrates a possible embodiment of a heating cable system. The heating cable 40 can be the same configuration as heater cable 10 shown in FIG. 1 and can include a center bus wire 12, a plurality of radial bus wires 14, and interstitial filler material 20. Alternatively, heater cable 10 can have multiple configurations as discussed above. Heater cable 40, can be coupled to a power supply 50, via power leads 52, 54. The power supply 50 can be an AC power supply or a DC power supply. Additionally, while the power supply 50 is shown with only a positive terminal 56 and a negative terminal 58, it should be understood that the power supply 50 in FIG. 2 is for illustrative purposes only and can include multiple configurations. For example, the power supply 50 can have multiple output ports, capable of outputting multiple voltage levels. Further, the power supply 50 can be a multi-phase AC power supply. In some embodiments, the power supply 50 can be a simple power source, i.e. a connection to a utility provided power.

Power lead 52 can be coupled to the positive output terminal 56 of the power supply 50, and to the center bus wire 12 to provide a positive voltage potential to center bus wire 12. Alternatively, power lead 52 can be coupled to the negative output terminal 58 of the power supply 50 to provide a negative (i.e. lower potential or ground) voltage potential to center bus wire 12. Additionally, the at least one radial bus wires 14 can be coupled to the negative output terminal 58 of the power supply 50 via power lead 54 to provide a negative (i.e. lower potential or ground) voltage potential to the at least one radial bus wires 14. Alternatively, the at least one radial bus wires 14 can be coupled to the positive output terminal 58 of the power supply 50 via power lead(s) 54 to provide a positive voltage potential to the at least one radial bus wires 14. In some embodiments, each of the at least one radial bus wires 14 can be connected to individual power supply 50 outputs. As discussed above, this can allow a user to apply a specific voltage to each of the radial bus wires 14 to allow for specific temperature setpoints to be achieved. The system of FIG. 2 represents one possible embodiment of a heating cable system, multiple further embodiments, such as those discussed above, can further be implemented as required for a given application.

Figure 3:
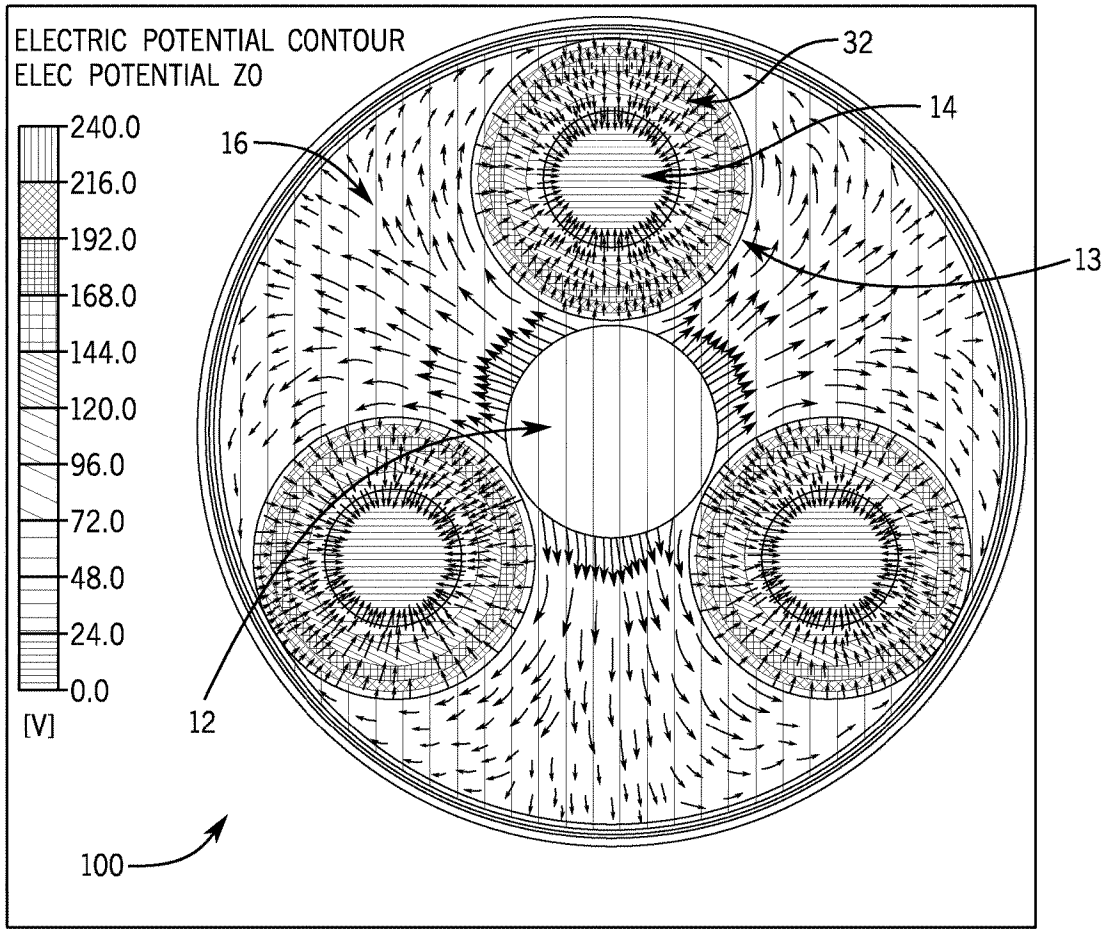
FIGS. 3 and 4 are cross-sectional diagrams illustrating electrical characteristics of the heater cable of FIG. 1 in accordance with various embodiments of the present disclosure.
Figure 4:
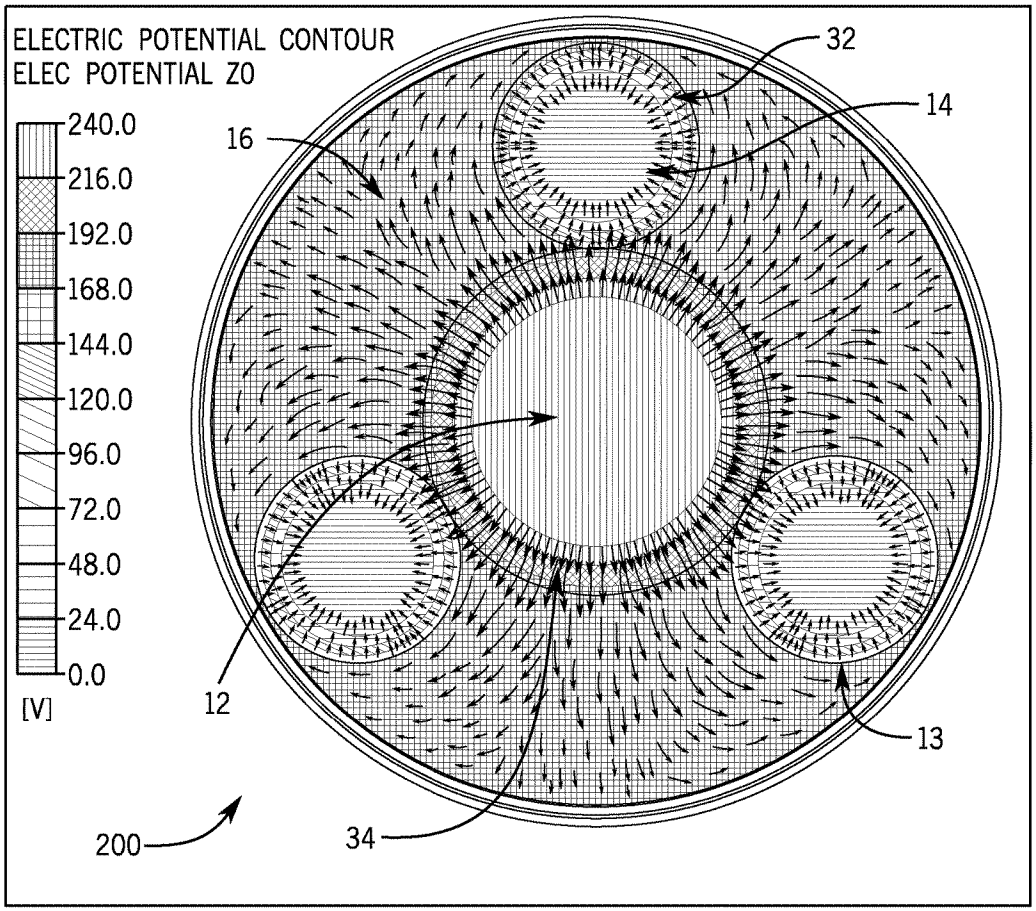

Turning now to FIGS. 3 and 4, a voltage potential distribution and a current distribution (shown by black vector arrows) within a heater cable are illustrated in accordance with various embodiments. FIG. 3 shows an embodiment of a heater cable 100 wherein the radial bus wires 12 are encapsulated with PTC material 32 while the center bus wire 12 is bare (i.e., not covered with PTC material). As can be seen, the center bus wire 12 and the interstitial space 16 share an identical or near identical voltage potential (i.e., high voltage) and the radial bus wires 14 share an identical voltage potential (i.e., low) with each other. The interstitial space 16 can include interstitial filler material 20 as discussed above. A voltage drop occurs across the PTC material 32. Because the voltage potential encountered by nearly the entirety of the circumference of the PTC material 32 is identical (by virtue of the highly conductive coating 13), the voltage drop across the PTC encapsulation 32 is substantially uniform, and thus the current flow therethrough is substantially uniform, resulting in substantially uniform heat generation. It should be noted that in certain embodiments, a first metallic foil wrap 24 (discussed above) can be in direct contact with all or portions of the interstitial space 16 and can further aid in electrical distribution of current within and across portions of the interstitial space 16.

FIG. 4 illustrates a slightly different embodiment where both the radial bus wires 14 and the center bus wire 12 are encapsulated in PTC material 32, 34 in heater cable 200. A first voltage drop occurs across the PTC material 34 around the center bus wire 12 with a corresponding first heat generation effect. The interstitial space 16 then has a reduced voltage potential, but is still uniform throughout. This can be the result of the interstitial filler material 20 within the interstitial space 16. A second voltage drop occurs across the PTC material 32 around the radial bus wires 14 corresponding to a second heat generation effect. Because the interstitial space 16 has a uniform voltage potential due to the interstitial filler material 20, the current through both PTC materials 32, 34 is relatively uniform throughout their respective circumferences, thereby spreading heat generation evenly throughout the entirety of the encapsulations of PTC materials 32, 34.

Figure 5:
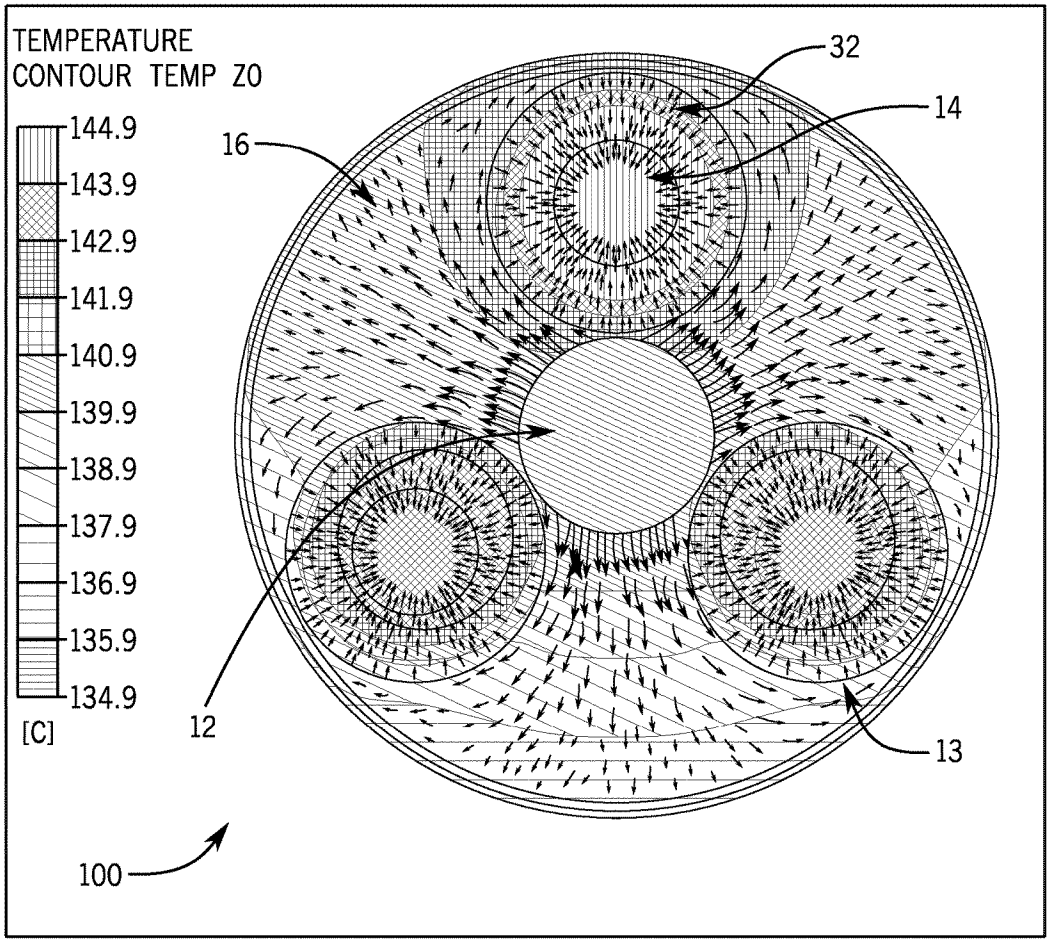
FIGS. 5 and 6 are cross-sectional diagrams illustrating thermal characteristics of the heater cable of FIG. 1 in accordance with various embodiments of the present disclosure.
Figure 6:
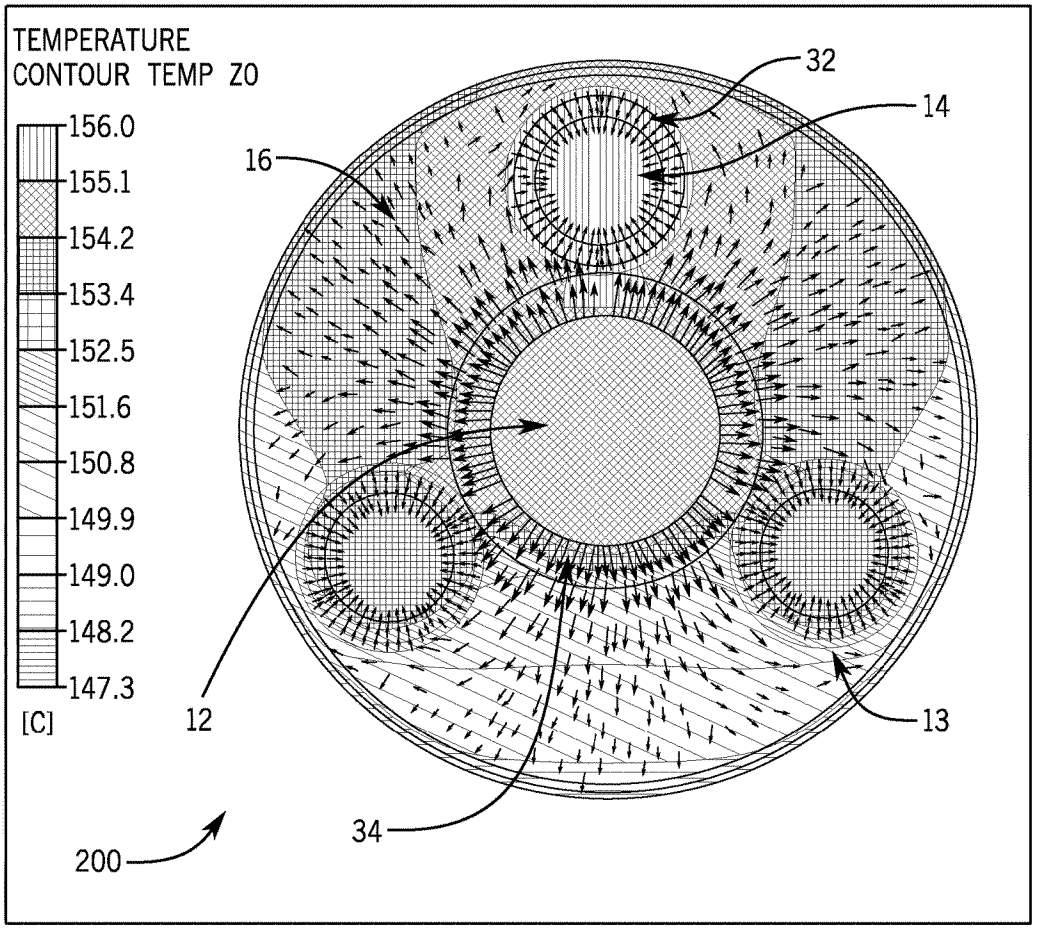

Turning now to FIGS. 5 and 6, heat distribution profiles are illustrated in accordance with various embodiments described herein. The heater cable 100 shown in FIG. 5 is identical to that of FIG. 3, whereas the heater cable 200 shown in FIG. 6 is identical to that of FIG. 4. The illustrative heat distribution profiles are shown assuming a thermal coupling on the lower edge to a heat sink (e.g., pipe, structure, or other material receiving heat, correlated to the bottom of the page). As can be seen in both FIGS. 5 and 6, the heat generated by the PTC material 32, 34 is spread relatively evenly across the entire cross-section of the heater cable 100, 200. For example, as is shown in FIGS. 5 and 6, a temperature differential of less than 10° C. is seen across the entire cross section heater cable 100, 200. Within the heater cable 100, 200 cores, temperature differentials of less than 7° C. can be seen. These figures therefore illustrate effective thermal equalization across the entire heater cable 100, 200 cross-section.

Figure 7:
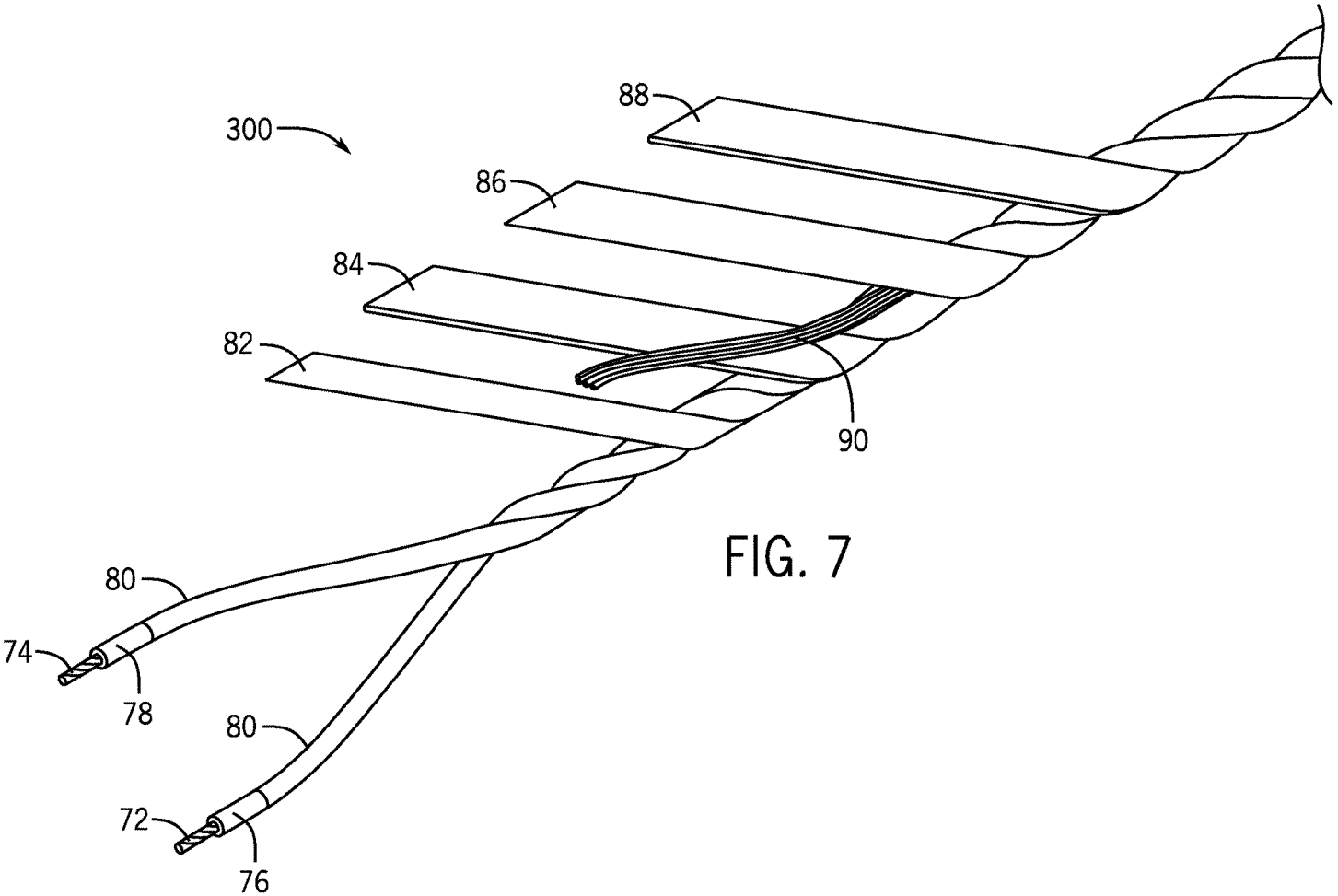
FIG. 7 is an exploded perspective view of another heater cable in accordance with another embodiment of the present disclosure.
Figure 8:
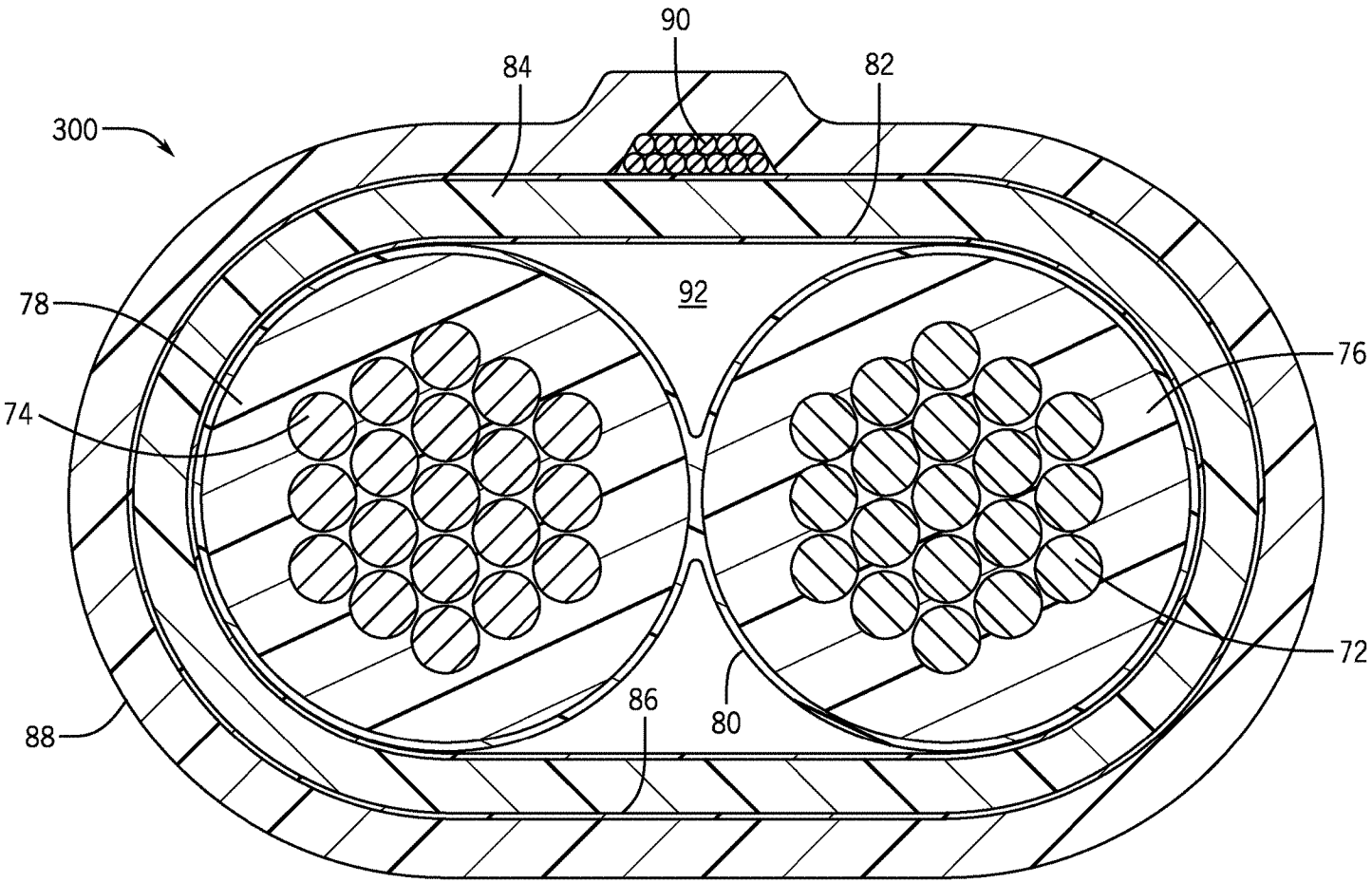
FIG. 8 is a cross-sectional diagram of the heater cable of FIG. 7.

FIGS. 7 and 8 illustrate another embodiment of a heater cable 300 having the properties described above. A first bus wire 72, like the center bus wire 12 of FIG. 1, can have a PTC material cover 76 encapsulating the first bus wire 72, as described above with respect to the PTC material 34. A second bus wire 74, like one of the radial bus wires 14 of FIG. 1, can also have a PTC material cover 78 encapsulating the second bus wire 74 as described above with respect to the PTC material 32. Thus, the PTC materials and the thicknesses of the covers 76, 78, can be the same or different. The bus wires 72, 74 themselves can be solid-core or multi-stranded, as illustrated, and can be the same or different diameters. The bus wires 72, 74 can be twisted together (i.e., around the center axis of the cable 300), and can form a twisted pair cable that may reduce electromagnetic interference and improve efficiency of current and/or heat transfer from the first bus wire 72 to the second bus wire 74 through the covers 76, 78.

One or both of the bus wires 72, 74 can be coated with a conductive coating 80, such as conductive ink or another material as described above with respect to the interstitial coating 13 of FIG. 1. The coating 80 can be applied to the bare wire, or to the external surfaces of the covers 76, 78. The coating 80 can be applied around the entire circumference (i.e., on the entire surface area) of the external surface, or the coating 80 can be applied to only a portion of the external surface. Each bus wire 72, 74 can be separately coated before the bus wires 72, 74 are twisted together. In such embodiments, the bus wires 72, 74 can be twisted together before the coating 80 has dried or otherwise hardened, which can allow the coatings 80 of the separate wires to flow or fuse together, or otherwise conglomerate, at the point of contact between the bus wires 72, 74. This can create a thicker portion of the coating 80 at the point of contact, as shown in FIG. 8. Alternatively, the bus wires 72, 74 can be twisted together after the coatings 80 have dried or hardened. Additionally or alternatively, the bus wires 72, 74 can be twisted together and then coated with the coating 80. In such embodiments, the covers 76, 78 may contact each other beneath the coating 80. The coating 80 can be the same thickness or a different thickness on each of the bus wires 72, 74.

A jacket can be formed from several layers, similar to the construction described above with respect to FIG. 1. An inner conductive layer 82 can be a metallic foil or other suitable conductive film that is wrapped (as shown) or otherwise disposed over the twisted pair of bus wires 72, 74. The inner conductive layer 82 may contact the coating 80 and facilitate uniform distribution of the current during current transfer. The wrapping of the inner conductive layer 82 can define the interstitial spaces 92 between the first bus wire 72, the second bus wire 74, and the inner conductive layer 82. The interstitial spaces 92 can be voids or can be filled with an interstitial filler as described above. The coating 80 may further be applied to an internal surface of the inner conductive layer 82.

A dielectric layer 84 can be wrapped (as shown) or otherwise disposed over the inner conductive layer 82. Alternatively, the inner conductive layer 82 can be omitted, and the coating 80 can be applied to an internal surface of the dielectric layer 84. The dielectric layer can be an electrically insulating material as described above with respect to the dielectric jacket layer 26 of FIG. 1. A second conductive layer 86 can be wrapped or otherwise disposed over the dielectric layer 84. As described above with respect to the second metallic wrap 28, the second conductive layer 86 can be a metallic foil or another suitable conductive material. Alternatively, the second conductive layer 86 can be omitted, and the coating 80 can be applied to an external surface of the dielectric layer 84. The second conductive layer 86 can be in electrical contact with one or more drain wires 90 serving as the ground wire of the heater cable 300. An outer jacket layer 88 can be wrapped or otherwise disposed around the other layers of the jacket. The outer jacket layer 88 can have the properties of the outer environmental jacket 30 of FIG. 1.

As illustrated in FIG. 8, the heater cable 300 can have a generally elongated cross-sectional shape. A heater cable 300 having a generally elongated cross-sections shape can have one or more flat surfaces, which can be useful where the heater cable 300 is coupled to another substantially flat surface to be heated. Additionally, the heater cable 300 can also be configured to have other cross-sectional shapes, such as a round shape, an oval shape, or other shape required for a given application. In one embodiment, a filling material (not shown) can be used to provide structural support within the heater cable 300 to shape the cable into a alternate shape, such as a rounded shape. In one example, the filler material can be inserted into the interstitial space 92 to modify the shape of the heater cable 300. In an alternate embodiment, the filling material can be inserted between one or more layers of the jacket. For example, the filling material can be inserted between inner conductive layer 82 and the internal surface of the dielectric layer 84, between the dielectric layer 84 and the second conductive layer 86, between the second conductive layer 86 and the outer jacket layer 88, or any combination thereof. Further, the filler material can be placed between any of the layers discussed above, as well as in the interstitial space 92.

In one embodiment, the filler material can be an electrically and/or thermally conductive material, an electronically and/or thermally non-conductive material, or a combination thereof. Generally, the filling material is be selected based on requirements of the heater cable 300 application. For example, electrical conductivity, thermal conductivity, temperature rating, thermal resistance, chemical resistance, etc., are all factors that can be used when selecting the filling material. In one embodiment, similar materials to the described in relation to the interstitial filler material 20 discussed above can be used as the filling material. For example, fluoropolymers, primary secondary amine (PSA) carbon black or other carbon blacks (including but not limited to conventional spherical shaped carbon black, acetylene black, amorphous black, channel black, furnace black, lamp black, thermal black, and single-wall or multi-wall carbon nanotubes), graphite (including but not limited to natural, synthetic, or nano), additives (for example, zinc oxide (ZnO) as an antioxidant, boron nitride (BN) as a processing aid, and others), non-carbon-based (e.g., silver-based or polymer-based) conductive inks, and/or mixtures of any of the above, are suitable materials for use as the filling material. Other filling materials such as, glass fiber, glass bead, metallic powder, metallic fiber, ceramic powder, ceramic fiber, and the like, and combinations of such suitable materials can also be used as the filling material. In one embodiment, the same filling material can be used throughout the heater cable 300. Alternatively, different filling material types can be used throughout the heater cable 300. For example, a first filling material type can be used in the interstitial space 92, and a second filling material type can be used between the layers 82, 84, 86, 88. Further, different filling material types can be used between each of the layers 82, 84, 86, 88 as well as the interstitial space 92.

So configured, a heater cable is described capable of having improved thermal equalization characteristics according to various embodiments, such as those described above. Additionally, the design of the heater cable in various embodiments allows for flexibility and ruggedness while maintaining a maximized thermal equalization, which, in particular, is a new and useful result. Further still, the heater cable in accordance with various embodiments is capable of producing varying selective heat output levels by selectively activating and deactivating various bus wires therein.

The present invention has been described in terms of one or more preferred embodiments, and it should be appreciated that many equivalents, alternatives, variations, and modifications, aside from those expressly stated (e.g., methods of manufacturing, product by process, and so forth), are possible and within the scope of the invention.

We claim:

1. A heater cable comprising:

a center bus wire extending axially along the heater cable;

a first radial bus wire extending axially along the heating cable and positioned adjacent to the center bus wire;

a first cover encapsulating the first radial bus wire, the first cover comprising a first positive temperature coefficient (PTC) material;

a second radial bus wire extending axially through the heating cable and positioned adjacent to the center bus wire;

a second cover encapsulating the second radial bus wire, the second cover comprising the first PTC material;

a third radial bus wire extending axially through the heating cable and positioned adjacent to the center bus wire;

a third cover encapsulating the third radial bus wire, the third cover comprising the first PTC material; and a thermally and electrically conductive coating disposed on the first cover, the second cover, and the third cover, the coating forming one or more electrical paths for an electric current carried by the center bus wire to be conducted to the first radial bus wire through the first cover, to the second radial bus wire through the second cover, and to the third radial bus wire through the third cover, with a substantially uniform distribution of the electric current within the first PTC material of each of the first cover, the second cover, and the third cover;

the first PTC material having a substantially higher resistance than the center bus wire, the first radial bus wire, and the coating.

2. The heater cable of claim 1, wherein the center bus wire is disposed on a central axis of the heater cable, and wherein the first radial bus wire, the second radial bus wire, and the third radial bus wire are:

uniformly spaced apart from each other in a radial arrangement around the center bus wire; and helically wrapped around the center bus wire at a substantially constant number of wraps per foot of length of the heater cable.

3. The heater cable of claim 1, further comprising:

a jacket disposed over and containing the center bus wire, the first radial bus wire, the second radial bus wire, and the third radial bus wire, the jacket defining a first interstitial space between the first radial bus wire and the second radial bus wire, a second interstitial space between the second radial bus wire and the third radial bus wire, and a third interstitial space between the third radial bus wire and the first radial bus wire, the jacket comprising a metallic foil layer in electrical contact with the coating; and an interstitial filler material disposed in the first interstitial space, the second interstitial space, and the third interstitial space.

4. The heater cable of claim 1, further comprising a fourth cover encapsulating the center bus wire, the fourth cover comprising a second PTC material;

the coating further being disposed on the fourth cover, the electrical paths further allowing the electric current to be conducted through the fourth cover with a substantially uniform distribution of the electric current within the second PTC material of the fourth cover.

5. A heater cable comprising:

a center bus wire extending axially along a central axis of the heater cable;

at least one radial bus wire extending axially through the heating cable and positioned adjacent to the center bus wire;

a positive temperature coefficient (PTC) material encapsulating at least one of:

the center bus wire; and one or more of the at least one radial bus wire;

a thermally and electrically conductive interstitial material disposed on the PTC material, the interstitial material forming one or more electrical paths for an electric current carried by the center bus wire to be conducted to the at least one radial bus wire through the PTC material with a substantially uniform distribution of the electric current within the PTC material; and a jacket disposed about the interstitial material, the center bus wire, and the at least one radial bus wire, the jacket comprising a first conductive layer, a second conductive layer, and a dielectric layer positioned between the first conductive layer and the second conductive layer.

6. The heater cable of claim 5, wherein the PTC material is a polymer-carbon compound.

7. The heater cable of claim 5, wherein the interstitial material is carbon black.

8. The heater cable of claim 5, wherein the first conductive layer and the second conductive layer are comprised of a metallic foil.

9. The heater cable of claim 5, wherein the at least one radial bus wire and the at least one center bus wire have equal cross sectional diameters.

10. The heater cable of claim 5, wherein the at least one radial bus wire is helically positioned around the at least one center bus wire.

11. A heater cable comprising:

a center bus wire extending axially along a central axis of the heater cable;

a first radial bus wire, a second radial bus wire, and a third radial bus wire each extending axially through the heating cable, the first, second, and third radial bus wires disposed radially about the center bus wire and physically separated from one another and from the center bus wire;

a PTC material encapsulating each of the first, second, and third radial bus wires; and an electrically conductive interstitial material coating an outer surface of the PTC material, having an electrical resistance substantially less than an electrical resistance of the PTC material, and forming one or more electrical paths for an electric current carried by the center bus wire to be conducted to each of the first radial bus wire, the second radial bus wire, and the third radial bus wire through the PTC material with a substantially uniform distribution of the electric current within the PTC material.

12. The heater cable of claim 11, further comprising a jacket disposed about the interstitial material, the center bus wire, and the first, second, and third radial bus wires.

13. The heater cable of claim 11, wherein the PTC material has a plurality of thicknesses along a length of the first radial bus wire.

14. The heater cable of claim 11, wherein the center bus wire is encapsulated with the PTC material.

15. The heater cable of claim 14, wherein the center bus wire, the first radial bus wire, the second radial bus wire, and the third radial bus wire are encapsulated with an equal thickness of the PTC material.

16. The heater cable of claim 14, wherein the PTC material forms a first cover around the first radial bus wire and a second cover around the center bus wire, the outer surface of the PTC material including external surfaces of the first cover and the second cover.

17. The heater cable of claim 16, wherein the first cover is physically separated from the second cover by the interstitial material.

18. The heater cable of claim 12, wherein the interstitial material further coats an inner surface of the jacket.

19. The heater cable of claim 12, further comprising an interstitial space defined by one or more voids between an inner surface of the jacket and the outer surface of the PTC material.

20. The heater cable of claim 19, wherein the interstitial material comprises a first portion coating the outer surface of the PTC material and a second portion coating the inner surface of the jacket, the first portion contacting the second portion at one or more points.

* * * * *